US007572364B2

(12) United States Patent
Evans et al.

(10) Patent No.: US 7,572,364 B2
(45) Date of Patent: Aug. 11, 2009

(54) FLUID CATALYTIC CRACKING SYSTEM WITH FINES ADDITION SYSTEM

(75) Inventors: Martin Evans, Tolland, CT (US); Manfred William Brown, London (GB)

(73) Assignee: Intercat Equipment, Inc., Manasquan, NJ (US)

( * ) Notice: Subject to any disclaimer, the term of this patent is extended or adjusted under 35 U.S.C. 154(b) by 197 days.

(21) Appl. No.: 11/380,566

(22) Filed: Apr. 27, 2006

(65) Prior Publication Data

US 2007/0251862 A1 Nov. 1, 2007

(51) Int. Cl.
*C10G 45/00* (2006.01)
*F27B 15/08* (2006.01)

(52) U.S. Cl. ..... 208/152; 208/161; 208/164; 422/144; 422/145; 422/147

(58) Field of Classification Search ..... 208/152, 208/113, 161, 164; 422/139, 144, 145, 147; 585/639

See application file for complete search history.

(56) References Cited

U.S. PATENT DOCUMENTS 2,916,441 A * 12/1959 Kruse, Jr. ..... 208/152
3,294,675 A * 12/1966 Adams et al. ..... 208/152
4,082,513 A * 4/1978 Andon et al. ..... 406/124
4,769,127 A 9/1988 Erickson et al.
4,813,381 A * 3/1989 Kullendorff et al. ..... 122/4 D
4,981,111 A * 1/1991 Bennett et al. ..... 110/347
5,104,519 A * 4/1992 Haddad et al. ..... 208/152
5,389,236 A * 2/1995 Bartholic et al. ..... 208/152
5,810,045 A 9/1998 Evans
6,358,401 B1 * 3/2002 Evans ..... 208/152
6,859,759 B2 * 2/2005 Evans ..... 702/188
2004/0064006 A1 * 4/2004 Beech et al. ..... 585/639
2005/0203326 A1 * 9/2005 Miller et al. ..... 585/640
2007/0088187 A1 * 4/2007 Miller et al. ..... 585/639

FOREIGN PATENT DOCUMENTS

WO WO 2005/095549 * 3/2005
WO WO 2005/095549 A2 10/2005

OTHER PUBLICATIONS

International Search Report and Written Opinion for PCT/US07/65506, Dec. 19, 2007.
"IMS to Control Room", Dwg S-29, Sheet 1, Intercat, Savannah, Georgia, Nov. 26, 2001.

* cited by examiner

*Primary Examiner*—N. Bhat
(74) *Attorney, Agent, or Firm*—Tanzina Chowdhury Patterson & Sheridan

(57) ABSTRACT

A fines injection apparatus, a fluid catalytic cracking (FCC) system having a fines injection apparatus, and a method for using the same are provided. In one embodiment, a FCC system includes a FCC unit, a fines collector, and a fines injector coupled to the fines collector for retuning the fines recovered in the fines collector to the FCC unit. In another embodiment, an apparatus for injecting fines into a FCC system includes a fines separator coupled to an effluent stream and an injection apparatus coupled to a regenerator. A conduit is provided for delivering collected fines from the fines separator to the injection apparatus. In yet another embodiment, a method for injecting fines into FCC system includes collecting fines from a waste stream of a FCC system, automatically transferring the collected fines to a fines injection apparatus, and periodically injecting the transferred fines into the FCC system.

22 Claims, 4 Drawing Sheets

FLUID CATALYTIC CRACKING SYSTEM WITH FINES ADDITION SYSTEM

FIELD OF THE INVENTION

Embodiments of the invention generally relate to a fluid catalytic cracking system, and more specifically to a fluid catalytic cracking system having a fines addition system.

DESCRIPTION OF THE RELATED ART

FIG. 1 is a simplified schematic of a conventional fluid catalytic cracking system 130. The fluid catalytic cracking system 130 generally includes a fluid catalytic cracking (FCC) unit 110 coupled to a catalyst injection system 100, a petroleum feed stock source 104, an exhaust system 114 and a distillation system 116. One or more catalysts from the catalyst injection system 100 and petroleum from the petroleum feed stock source 104 are delivered to the FCC unit 110. The petroleum and catalysts are reacted in the FCC unit 110 to produce a vapor that is collected and separated into various petrochemical products in the distillation system 116. The exhaust system 114 is coupled to the FCC unit 110 and is adapted to control and/or monitor the exhausted byproducts of the fluid cracking process.

The FCC unit 110 includes a regenerator 150 and a reactor 152. The reactor 152 primarily houses the catalytic cracking reaction of the petroleum feed stock and delivers the cracked product in vapor form to the distillation system 116. Spent catalyst from the cracking reaction is transferred from the reactor 152 to the regenerator 150 where the catalyst is rejuvenated by removing coke and other materials. The rejuvenated catalyst is reintroduced into the reactor 152 to continue the petroleum cracking process. By-products from the catalyst rejuvenation are exhausted from the regenerator 150 through an effluent stack of the exhaust system 114.

The catalyst injection system 100 maintains a continuous or semi-continuous addition of fresh catalyst to the catalyst inventory circulating between the regenerator 150 and the reactor 152. The catalyst injection system 100 includes a main catalyst source 102 and one or more additive sources 106. The main catalyst source 102 and the additive source 106 are coupled to the FCC unit 110 by a process line 122. A fluid source, such as a blower or air compressor 108, is coupled to the process line 122 and provides pressurized fluid, such as air, that is utilized to carry the various powdered catalysts from the sources 102, 106 through the process line 122 and into the FCC unit 110.

One or more controllers 120 is/are utilized to control the amounts of catalysts and additives utilized in the FCC unit 110. Typically, different additives are provided to the FCC unit 110 to control the ratio of product types recovered in the distillation system 116 (i.e., for example, more LPG than gasoline) and to control the composition of emissions passing through the exhaust system 114, among other process control attributes. As the controller 120 is generally positioned proximate the catalyst sources 106, 102 and the FCC unit 110, the controller 120 is typically housed in an explosion-proof enclosure to prevent spark ignition of gases which may potentially exist on the exterior of the enclosure in a petroleum processing environment.

In order to facilitate efficient transfer of the catalyst between the reactor and regenerator, the circulating catalyst must be maintained at a size distribution that facilitates efficient transfer between these vessels. When the size distribution is such that catalyst transfer readily occurs, the catalyst is commonly described as being in a fluidized state. Critical to maintaining the catalyst in the fluidizable state is the presence of a minimum number of small media particles or fines. Generally, the fines have an average particle size of about 30 microns, with the majority of fines having a particle size between 20 and 40 microns, although the size distribution will vary from refinery to refinery.

During the course of normal refining, fines may be lost in the product stream, consumed in the FCC unit or entrained with the effluents exiting the regenerator. If enough fines are lost, the circulation rate of catalyst between the reactor and regenerator may decrease, thereby rendering the process unstable or out of balance. As these changes in the dynamic equilibrium force the FCC unit away from its optimal operating limits, the desired product mix and/or effluent composition may not be obtained. As the FCC unit is a major profit center in most refineries, a great deal of time and investment is made by refineries to ensure that the FCC unit is always operating against its operating limits, thereby maximizing profitability. Anything that forces the operation of the FCC unit away from these limits reduces profitability to the detriment of the refiner. Thus, it would be highly desirable to stabilize the FCC operation by ensuring the continuous circulation of catalyst within the FCC unit, thus maintaining the dynamic balance of catalyst in the FCC unit.

To mitigate the continual loss of fines, refiners may periodically replenish the fines in the FCC unit. Fines are conventionally added by removing catalyst from one of the catalyst injection systems coupled to the FCC unit, and utilizing the emptied injection system to replenish the number of fines in the system with new (e.g., unused) fines provided by a catalyst vendor. This method is cumbersome for refiners, as an empty catalyst injection system is not always available, and the process operation may be temporarily disoptimized while fines instead of catalyst are in the injection system.

Therefore, there is a need for a fluid catalyst cracking unit having a fines addition system.

SUMMARY OF THE INVENTION

Embodiments of the invention generally include a fines addition system, a fluid catalytic cracking (FCC) system having a fines addition system, and a method for using the same. In one embodiment, a FCC system includes a FCC unit, a fines collector for recovering fines leaving the FCC unit, and a fines addition system coupled to the fines collectors for returning the recovered fines to the FCC unit.

In another embodiment, an apparatus for injecting fines into a FCC system includes a fines separator coupled to an effluent stream of an FCC unit and a fines addition system coupled to the FCC unit. A conduit is provided for delivering collected fines from the fines separator to the addition system.

In yet another embodiment, a method for injecting fines into FCC system includes collecting fines from a waste stream of a FCC system, automatically transferring the collected fines to a fines addition system, and periodically injecting the transferred fines into the FCC system.

DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, wherever possible, to designate identical elements that are common to the FIGS. It is contemplated that features from any one embodiment may be beneficially incorporated in other embodiments without additional recitation.

DETAILED DESCRIPTION

The invention generally provides a fines addition system, a fluid catalytic cracking (FCC) system having a fines addition system, and a method for injecting fines into a FCC unit. Advantageously, the invention facilitates the addition of fines to a catalyst inventory circulating in the FCC unit, allowing amount of fines present in the FCC unit to be balanced with little or no process disruption, thereby allowing the FCC unit to operate at higher efficiency for longer periods, as compared to conventional practices.

Figure 1:
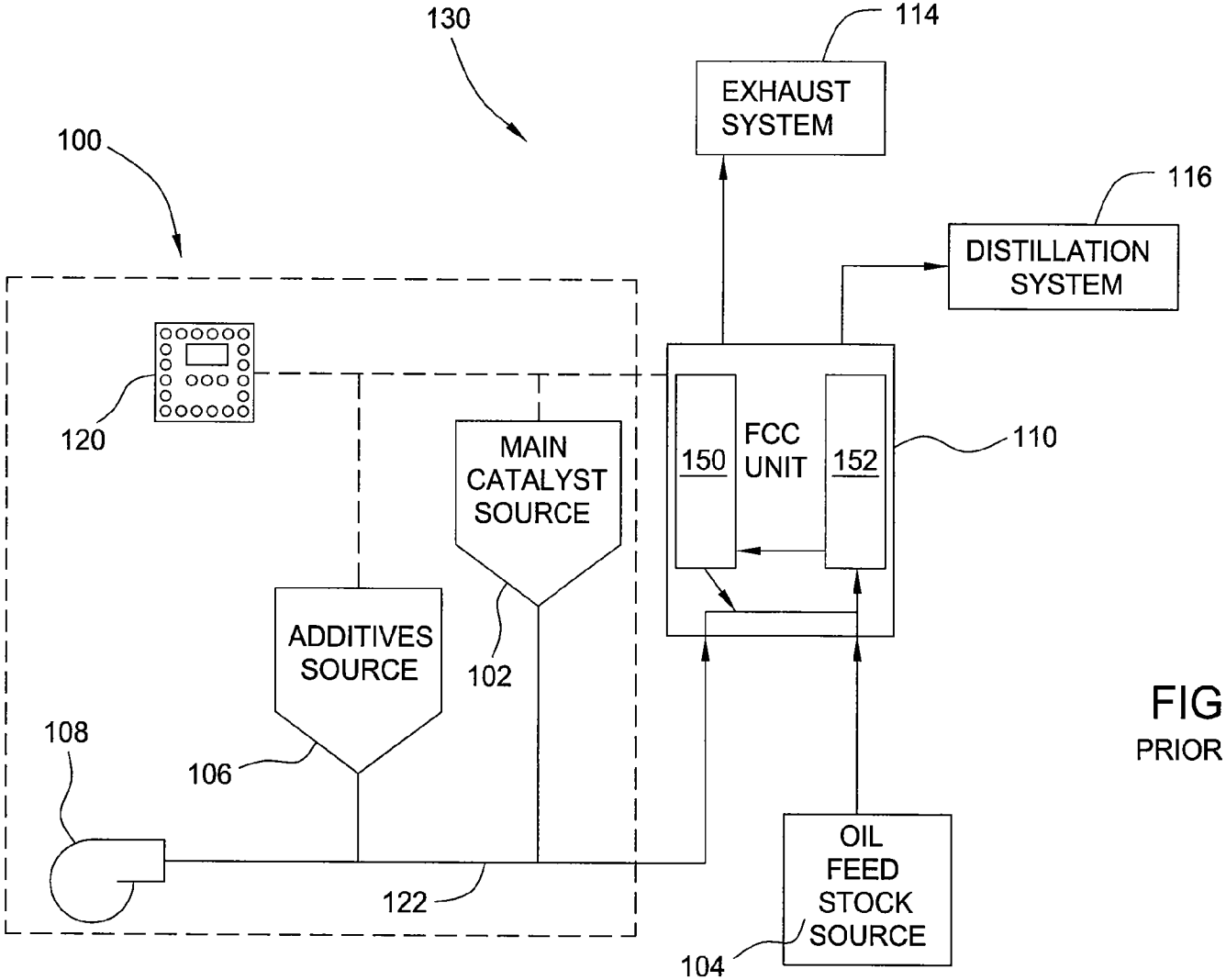
FIG. 1 PRIOR ART
FIG. 1 is a simplified schematic view of a conventional fluid catalytic cracking (FCC) system.
Figure 2:
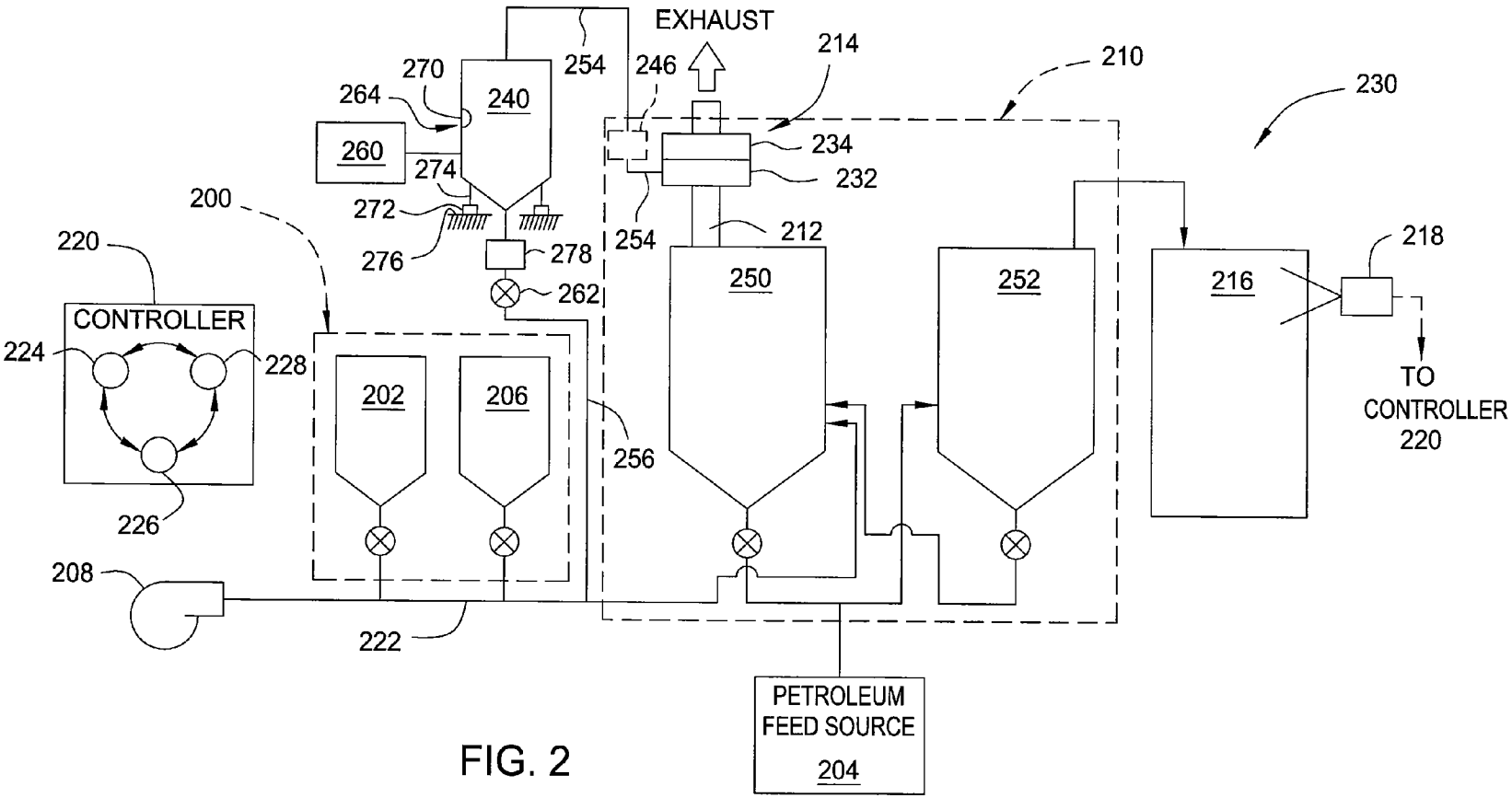
FIG. 2 is a simplified schematic diagram of a FCC system having a fines addition system in accordance with one embodiment of the present invention.

FIG. 2 is a simplified schematic of a fluid catalytic cracking system 230 having a fines addition system 240. The fluid catalytic cracking system 230 generally includes a fluid catalytic cracking (FCC) unit 210 coupled to a catalyst injection system 200 and the fines addition system 240, a controller 220, a petroleum feed stock source 204, a fines recovery system 214 and a distillation system 216. One or more catalysts from the catalyst injection system 200 and petroleum from the petroleum feed stock source 204 are delivered to the FCC unit 210. The petroleum and catalysts are reacted in the FCC unit 210 to produce a vapor that is collected and separated into various petrochemical products in the distillation system 216.

The FCC unit 210 includes a regenerator 250 and a reactor 252, as known in the art. The reactor 252 primarily houses the catalytic cracking reaction of the petroleum feed stock and delivers the cracked product in vapor form to the distillation system 216. Spent catalyst from the cracking reaction is transferred from the reactor 252 to the regenerator 250, where the catalyst is rejuvenated by removing coke and other materials. The rejuvenated catalyst is reintroduced into the reactor 252 to continue the petroleum cracking process. By-products from the catalyst rejuvenation process are exhausted from the regenerator 250 through an effluent stack.

The catalyst injection system 200 maintains a semi-continuous addition of fresh catalyst to the catalyst inventory circulating between the regenerator 250 and the reactor 252. The catalyst injection system 200 includes a main catalyst source 202 and one or more additive sources 206. The main catalyst source 202 and the additive source 206 are coupled to the FCC unit 210 by a process line 222. A fluid source, such as a blower or air compressor 208, is coupled to the process line 222 and provides pressurized fluid, such as air, that is utilized to carry the various powdered catalysts from the sources 202, 206 through the process line 222 and into the FCC unit 210.

Typically, different additives are specialized catalysts utilized for process control in the FCC unit 210. For example, additives may be provided from the addition source 206 to the FCC unit 210 to control the ratio of product types recovered in the distillation system 216 (i.e., for example, more LPG than gasoline) and/or to control the composition of emissions passing through an effluent stack 212 of the regenerator 250, among other process control attributes. The main catalyst source 202 generally delivers a Y-Zeolite containing catalyst, which drives the main cracking process. Examples of catalyst injection systems that may be adapted to benefit the invention are described in U.S. Pat. No. 5,389,236, issued Feb. 14, 1995; U.S. Pat. No. 6,358,401, issued Mar. 19, 2002; U.S. patent application Ser. No. 10/304,670 filed Nov. 2, 2002; U.S. Pat. No. 6,859,759 issued Feb. 22, 2005 U.S. Pat. No. 6,974,659 issued Dec. 13, 2005; U.S. patent application Ser. No. 10/445,543, filed May 27, 2003; and U.S. patent application Ser. No. 10/717,250, filed Nov. 19, 2003, all of which are hereby incorporated by reference in their entireties. Other suitable catalyst injection systems that may be adapted to benefit the invention are available from Intercat Equipment Corporation, located in Sea Girt, N.J., among other manufacturers.

The fines recovery system 214 is interfaced with the effluent stack 212 of the regenerator 250 and is adapted to remove fines entrained in the gas stream exiting the regenerator 250 through the stack 212. In one embodiment, the fines recovery system 214 includes one or more devices suitable for separating fines from the effluent stream. In the embodiment depicted in FIG. 2, the fines recovery system 214 includes at least one of a cyclone separator 232 and an electrostatic precipitator 234.

The separated fines are generally collected and transferred from the fines recovery system 214 to the fines injection system 240. The separated fines may be delivered between the fines recovery system 214 and the fines injection system 240 through a conduit 242, or may be stored in an intermediate container 246 (shown in phantom FIG. 2) for later delivery to the fines injection system 240. Since the separated fines are at an elevated temperature when removed from the stack 212, one or more heat transfer devices (shown in FIG. 3 and identified by reference numeral 358) may be utilized to reduce the temperature of the fines prior to and/or during the delivery to the fines injection system 240. The heat transfer devices 244 are discussed in further detail below.

The controller 220 is utilized to regulate the addition of catalysts and/or additives made by the injection system 200 and addition of fines made by the fines addition system 240, so that the dynamic equilibrium of catalyst within the FCC unit 210, which is driven at least in part by the size distribution of catalyst (such as the amount of fines present in the catalyst inventory of the FCC unit 210), may be maintained. The fines injection system 240 is configured to provide a metric of fines added to the FCC unit 210. This metric may be provided to the controller 220 and utilized to balance the amount of fines within the FCC unit 210 to ensure efficient movement of catalyst between the regenerator 250 and reactor 252, as further described below.

As the controller 220 is generally positioned proximate the FCC unit 210, the controller 220 is typically housed in an explosion-proof enclosure to prevent spark ignition of gases which may potentially exist on the exterior of the enclosure in a petroleum processing environment. The controller 220 may be equipped with remote access capability so that activity may be monitored from other locations, such as operations center or by catalyst suppliers. A controller having such capability is described in U.S. Pat. No. 6,859,759, issued Feb. 22, 2005 and U.S. patent application Ser. No. 10/304,670, filed Nov. 26, 2002, both of which are hereby incorporated by reference in their entireties. It is contemplated that suitable controllers may have alternative configurations.

The fines injection system 240 generally includes a pressure vessel 258, a pressure control system 260, a metering device 262 and at least one sensor 264 suitable for providing a metric indicative of fines injected into the FCC unit 210 through the fines injection system 240. In the embodiment depicted in FIG. 2, the fines injection system 240 includes a first sensor 270 configured to detect when a level of catalyst within the fines injection system 240 exceeds an upper and/or lower threshold. The first sensor 270 may be a differential pressure measurement device, optical transducer, a capacitance device, a sonic transducer or other device suitable for providing information from which the level or volume of fines disposed in the storage vessel 258 of the fines injection system 240 may be resolved. For example, if the first sensor 270 provides an indication to the controller 220 that the fines level (or amount) is greater than a predetermined quantity, the controller 220 may initiate a fines injection by the fines injection system 240.

In another embodiment, the sensor 264 may be a second sensor 272 which may be utilized to determine the weight of fines within the storage vessel 258 and/or added to the FCC unit 210. In the embodiment depicted in FIG. 2, the second sensor 272 is a plurality of load cells adapted to provide a metric indicative of the weight of fines in and/or passing through the storage vessel 258. The load cells are respectively coupled to a plurality of legs 274 that support the storage vessel 258 above a surface 276, such as a concrete pad or structural member. Each of the legs 274 has one load cell (sensor 272) coupled thereto. The controller 220 receives the outputs of the load cells and utilizes sequential data samples obtained therefrom to resolve the net amount of fines added to the FCC unit 210 after each addition cycle. The amount of fines present within the storage vessel 258 may also be determined as needed utilizing the load cells. The amount of fines added to the FCC unit 210 may be determined by either weight lost or weight gained computations utilizing the data provided by the load cells. Additionally, the net amount of fines added over the course of the production cycle may be monitored so that variations in the amount of fines added may be detected, which are indicative of the amount of fines lost in the system, and conversely, the amount of fines in the catalyst inventory present in the FCC unit 210.

Alternatively, the sensor 264 for detecting a metric indicative of the amount of fines in the storage vessel 258 may be a third sensor 278 that is adapted to detect a flow of fines through the fines injection system 240 or other conduit for moving fines. The flow sensor (third sensor 278) is adapted to detect the flow of fines through one of the components of the fines addition system 240. The flow sensor may be a contact or non-contact device and may be mounted to the conduit 254, the storage vessel 258, the metering device 262 or a conduit 256 coupling the storage vessel 258 to the FCC unit 210. In the embodiment depicted in FIG. 2, the flow sensor may be a sonic flow meter or capacitance device adapted to detect the rate of entrained particles (i.e., fines) moving through the conduit 254, within the storage vessel 258 and/or the conduit 256 exiting the system 240.

The metering device 262 is disposed in the conduit 256 to control the flow of fines into the conduit 256 and ultimately to the FCC unit 210 from the fines addition system 240. The metering device 262 may be an on/off valve, pump, displacement device or other device suitable for regulating the amount of fines passing from the storage vessel 258 and into the FCC unit 210. Other suitable metering devices include, but are not limited to, gear pumps, positive displacement devices, valves and the like. One suitable metering device 262 is a rotating shear disk valve, available from the Everlasting Valve Company, located in South Plainfield, N.J.

The metering device 262 may determine the amount of fines by weight, volume, timed dispense or by other manners. The fines addition rate will vary according to the size of the FCC unit, and the degree of fines loss that particular refinery is experiencing. Depending on the fines requirements of the FCC unit 210, the metering device 262 may be configured to inject about 0.5 to about 6 tons per day of fines into FCC unit 210 without interruption of processing. Of course, systems may be configured to provide larger or smaller amounts. The metering device 262 typically injects fines into the FCC unit 210 periodically over the course of a planned production cycle, typically 24 hours, in multiple shots of predetermined amounts spaced over the production cycle. However, fines may also be added to the FCC unit 210 in an "as needed" basis.

Figure 3:
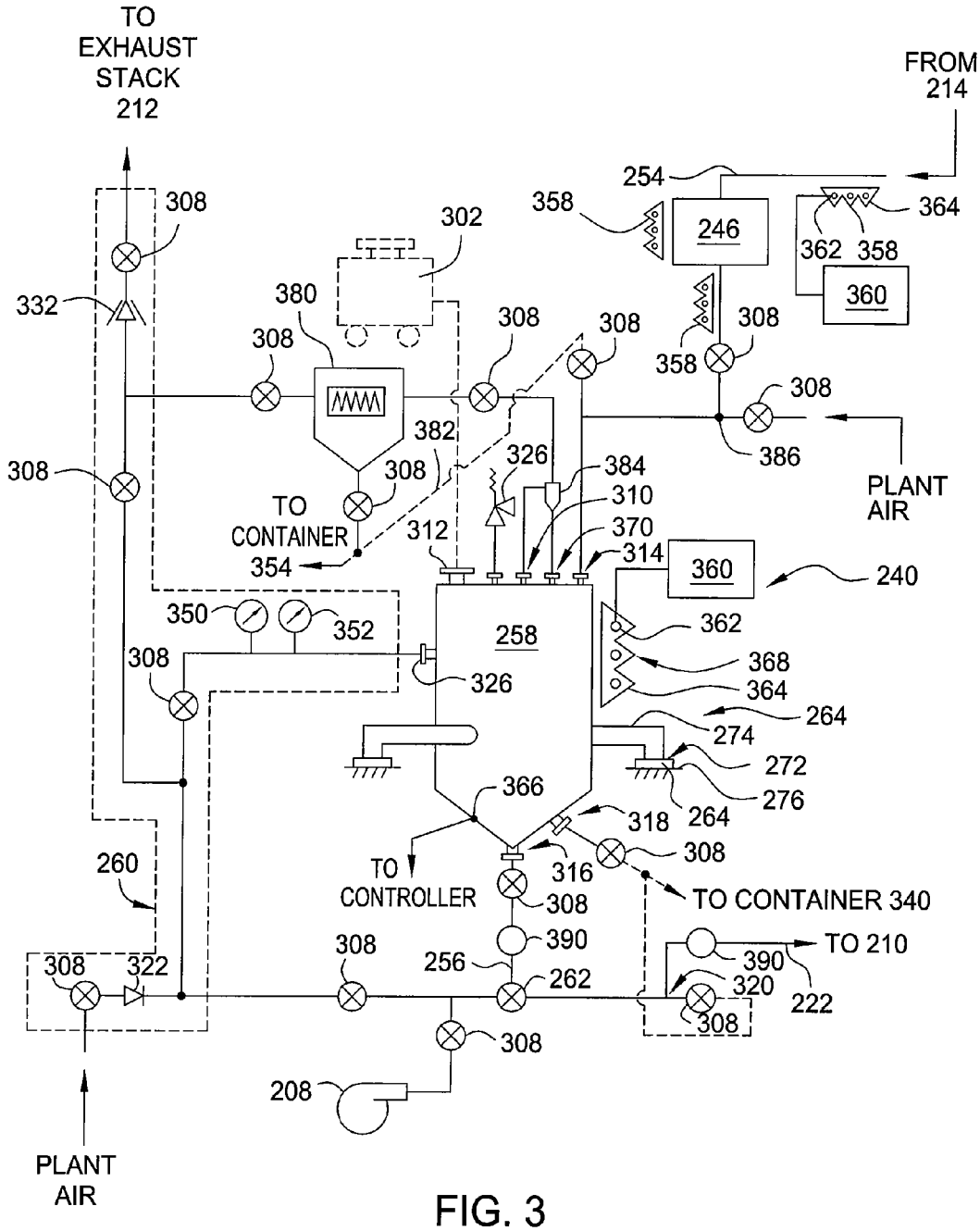
FIG. 3 is a sectional view of on embodiment of the fines addition system of FIG. 2.

FIG. 3 depicts a larger schematic view of one embodiment of the fines addition system 240. The storage vessel 258 of the fines addition system 240 is typically a metal container suitable for use at elevated pressures having a first fill port 314 and a first discharge port 316. The first discharge port 316 is positioned at or near a bottom of the storage vessel 258 and has the metering device 262 coupled thereto. Optionally, a second discharge port 318 may be positioned at or near a bottom of the storage vessel 258 to allow fines to be removed from the storage vessel 258 while bypassing the metering device 262. The second discharge port 318 may be coupled to a port 320 formed in the process line 222 or conduit 256, thereby allowing fines exiting the storage vessel 258 through the second discharge port 318 to enter the FCC unit 210 through the process line 222 in the event catalyst flow is prevented through the first discharge port 318. The second discharge port 318 may also be utilized to empty fines from the storage vessel 258 into a container 340. This feature allows the material present in the fines injection system 240 to be switched from fines to catalyst in emergency situations, and back to fines with minimal process disruption or effort by the refiner.

The pressure control system 260 is coupled to a pressure port 326 formed in the storage vessel 258 and controls the pressure within the storage vessel 258. The pressure control system 260 selectively pressurizes the storage vessel 258 to between about 5 to about 60 pounds per square inch (about 0.35 to about 4.2 kg/cm$^2$) during fines addition operations. In operation, the pressure control system 260 provides air at about 60 psi (about 4.2 kg/cm$^2$) into the interior of the storage vessel 258 to cause fines to flow from the storage vessel 258 through the actuated metering device 262 and into the FCC unit 210.

In one embodiment, the pressure control system 260 is configured to provide plant air or other gas into the storage vessel 258. Alternatively, the pressure control system 260 may utilize gas provided by the blower 208.

The air or other gas may also be utilized to fluidize, aerate and/or otherwise cool the fines disposed in the storage vessel 258. The pressure control system 260 may additionally be configured to control the flow of the air or other gas provided to the storage vessel 258, thereby providing the ability to optimize cooling of the collected fines and control environmental conditions within the storage vessel 258. Isolation valves 308 and check valves 322 are provided to selectively direct flow through the pressure control system 260. Other control valves 308 are shown to regulate flow on other conduits shown in FIG. 3.

In the embodiment depicted in FIG. 3, the pressure control system 260 includes a pressure meter 350 and a pressure transmitter 352 that are arranged to detect a metric of pressure within the storage vessel 258. The pressure transmitter 352 includes an output that is coupled to the controller 220 such that real time pressure information is available for process control. A relief valve 326 is coupled to the storage vessel 258 to prevent over pressurization.

The system 260 may intermittently vent the storage vessel 258 to about atmospheric pressure to accommodate filling the storage vessel 258 with fines from the fines recovery system 214 or other source. For example, the pressure within the storage vessel 258 vented and/or reduced to allow fines to be added to the storage vessel 258 through a second fill port 312, for example from a tote 302 or other container (shown in phantom).

The pressure control system 260 vents the storage vessel 258 through a vent port 310. The vent port 310 is coupled to the regenerator's exhaust stack 212 or other suitable effluent stack through a first fines removal device 380 such as a cyclone separator or filter. A control valve 308 is provided to selectively regulate (or prevent) flow through the vent port 310 from the storage vessel 258.

The first fines removal device 380 is utilized to minimize fines escaping from the storage vessel 258 during venting. Fines recovered by the first fines removal device 380 may be transferred through a return conduit 382 to the storage vessel 258, or alternately transferred to a container 354 for later addition to the storage vessel 258 or disposal. An eductor 332 or other vacuum source is provided between the first fines removal device 380 and the stack 212 to pull a vacuum across the first fines removal device 380 such that fines, entrained with the gases vented from the storage vessel 258, do not settle out and obstruct the conduits coupling the first fines removal device 380 to the storage vessel 258.

A second first fines removal device 384 may be disposed between the storage vessel 258 and the first fines removal device 380 to separate larger particulates from the vent stream. The second first fines removal device 384 may be a cyclone separator or filter. Separated particulates are returned from the second first fines removal device 384 to the storage vessel 258 through a return port 370 formed in the top of the storage vessel 258.

A flow indicator 390 may be positioned between the storage vessel 258 and the metering device 262 to provide a metric indicative that fines are flowing from the storage vessel 258. In one embodiment, the flow indicator 390 may be a sight glass. A control valve 308 may be positioned between the storage vessel 258 and the metering device 262 to allow the flow indicator 390 to be serviced. Other flow indicators 390 and control valves 308 are positioned in other locations beneficial to the operation of the system 240. For examples, control valves 308 are positioned between the storage vessel 258, metering device 262 and fines recovery system 214. These control valves 308 are interlocked to prevent simultaneous opening which could disrupt the planned flow of fines within the system 240. Other control valves 308 are not be discussed in further detail for the sake of brevity.

Due to the high temperature of the fines exiting the exhaust stream, one or more heat dissipaters 358 are provided to cool the fines before entering and/or while in the fines addition system 240. The heat dissipaters 358 may be coupled to or positioned approximate to the conduit 254 between the fines recovery system 214 and the storage vessel 258 and/or the container 246. The heat dissipater 358 may also be an integral part of the conduit 254. The heat dissipater 358 is configured to extract heat from the fines within conduit 254, thereby reducing the temperature of the fines flowing from the regenerator 250 to the fines addition system 240. In another embodiment, the conduit 254 may be coiled or define a torturous path such that the heat dissipater 358 may be interfaced with a greater length of conduit than if the conduit was routed in a straight line path, thereby improving the amount of heat transferred therebetween.

The heat dissipater 358 may also include one or more temperature regulating features. For example, the heat dissipater 358 may include heat transfer fins 364. In another embodiment, the heat dissipater 358 may include one or more conduits 362 coupled to a fluid source 360 through which a heat transfer fluid is flowed. By reducing the temperature of fines being collected from the effluent stream of the regenerator 250, the design constraint of the fines addition system 240 may be relaxed accordingly with the reduction in catalyst temperature entering the storage vessel 258.

Similarly, the storage vessel 258 may also be equipped with a thermal regulating device 368 to reduce the temperature of the storage vessel 258. The thermal regulating device 368 may be configured similar to the heat dissipater 358 described above. For example, the thermal regulating device 358 may include heat transfer fins 364. In another embodiment, the thermal regulating device 358 may include one or more conduits 362 coupled to a fluid source 360 through which a heat transfer fluid is flowed.

The storage vessel 258 may alternatively and/or additionally be cooled as described above by providing fluid from the pressure control system 260 into the storage vessel 258. The control valve 308 may also be periodically opened to allow heated gases disposed on the interior volume of the storage vessel 258 to be removed and replaced by cooler gas provided from the pressure control system 260.

The temperature of the gas and/or fines entering vessel 258 may be monitored using a sensor 366. The sensor 366 is coupled to the vessel 258 or to the first fill port 314. If the controller 220 determines, in response to a metric of temperature provided by the sensor 366, that the temperature of the gas and/or fines entering the vessel exceed a predefined limit, then a remedial action may be initiated. For example, remedial actions may include at least one of shutting off the flow into the storage vessel 258 to allow the system 240 to cool before restarting, emptying fines from vessel 258 using the regulating device 262 or port 318, increasing the heat extraction rate of the heat dissipater 368, flowing air into the vessel 258 from the one of the ports (such as the port 318 formed in the bottom of the vessel), or adding an extra flow of cold air to the fines leaving the regenerator to cool it down through a port 386 formed in the conduit 254.

Returning to FIG. 2, the controller 220 is provided to control the function of at least the fines addition system 240. The controller 220 may be any suitable logic device for controlling the operation of the fines addition system 240. The controller 220 generally includes memory 224, support circuits 226 and a central processing unit (CPU) 228, as is known.

In one embodiment, the controller 220 is a programmable logic controller (PLC), such as those available from GE Fanuc. However, from the disclosure herein, those skilled in the art will realize that other controllers such as microcontrollers, microprocessors, programmable gate arrays, and application specific integrated circuits (ASICS) may be used to perform the controlling functions of the controller 220. It is contemplated that the injection system 200 and the fines addition system 240 may have separate controllers, which may, or may not, be linked.

The controller 220 is coupled to the various support circuits 226 that provide various signals to the controller 220. These support circuits 226 may include power supplies, clocks, input and output interface circuits and the like. Other support circuits couple to the temperature sensor 366, the sensors 264, metering device 262, isolation valves 308, the pressure control system 260 and the like, to the controller 220.

The controller 220 is utilized to cause the fines addition system to perform a sequence of process steps, such as an injection method 400 described below with reference to FIG. 4. The method 400 may be stored within the memory 224, or may be accessed by the controller 220 from another memory source, local or remote.

Figure 4:
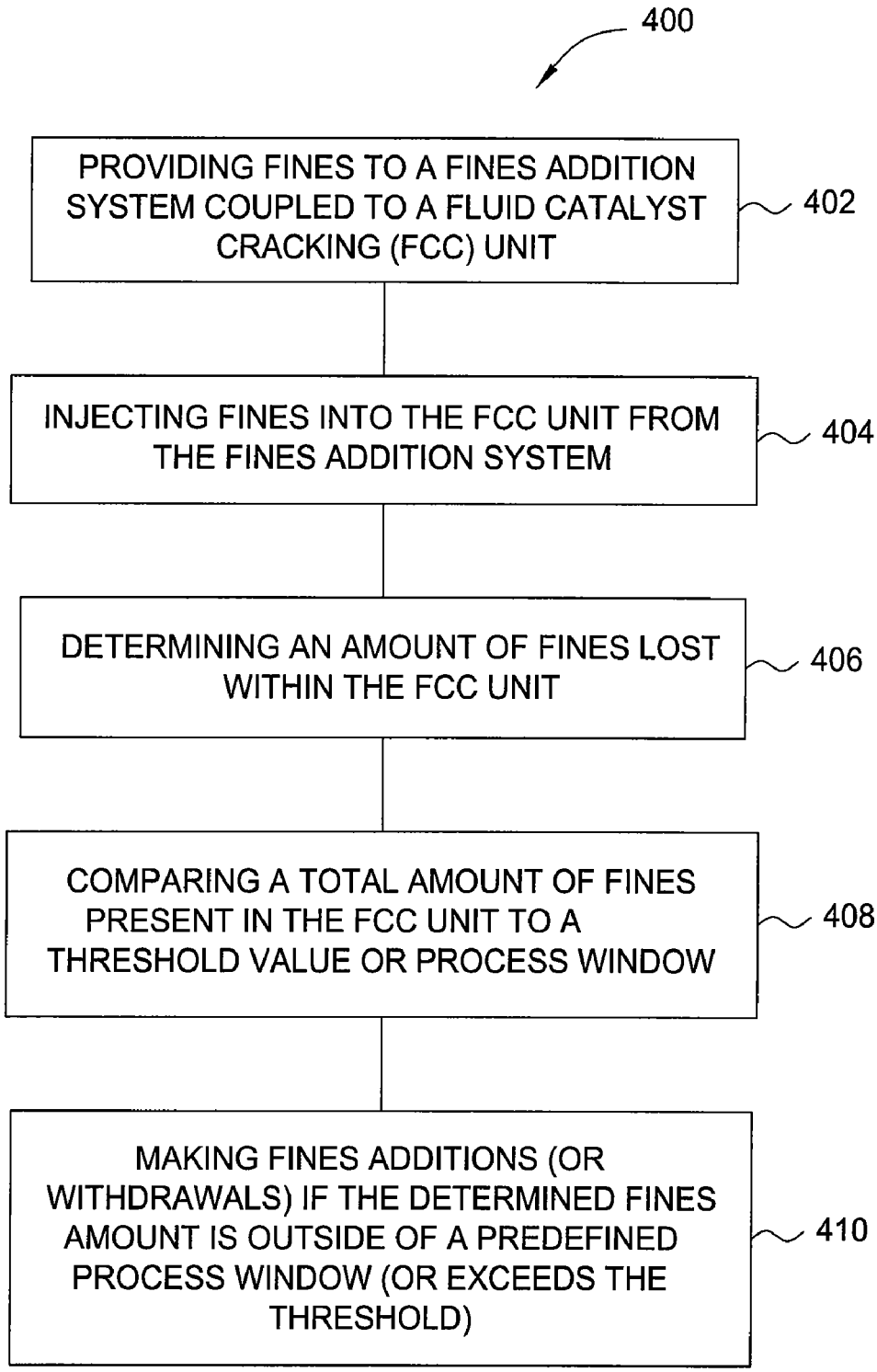
FIG. 4 is a flow diagram of one embodiment of a method of injecting fines in a FCC system.

FIG. 4 is flow diagram of one embodiment of a method 400 for adding fines to a FCC unit. The method 400 begins at step 402 providing fines to the fines addition system 240. In one embodiment, fines collected by the fines recovery system 214 from the effluent exiting the regenerator 250 are provided to the storage vessel 258. The fines may be provided directly, or temporarily stored in the container 246. Alternatively, or in addition to the recovered fines collected by the fines recovery system 214, new fines may be provided from another source, such as a tote 302. The tote 302 may contain new fines that have not been used in the FCC unit 210, or fines recovered from another FCC unit. The fines for the tote 302, or tote 302 containing fines, may be provided from a catalyst vendor, other refiner or other refinery.

At step 404, fines are injected into the FCC unit 210 from the fines addition system 240. During the fines injection step 404, a metric indicative of the amount of fines added to the FCC unit 210 are obtained using the sensor 264. The metric of fines addition may be attained in the form of a weight, volume and/or rate of fines added to the FCC unit 210, or by other suitable method.

The controller 220 is configured to determine the amount of fines added to FCC unit 210 during each addition cycle. The controller 220 may store addition information to memory 224, or export the information to another device, such as a control room computer at the refinery or to a remote device, such as a computer at the fines vendor via modem, wireless communication, land line or other communications protocol.

Optionally, the method 400 may continue to provide information regarding processing. In one embodiment, an amount of fines lost from and/or present in the catalyst inventory of the FCC unit 210 is determined at step 406. The amount of fines lost/present may be determined by utilizing the amount of catalyst and fines being added to the FCC unit 210 by the catalyst injection system 200 and the fines injection system 240 compensated with an amount of fines consumed in the FCC unit 210 and/or entrained on the product stream. The amount of fines consumed in the FCC unit 210 and/or entrained on the product stream may be measured, calculated, estimated or approximated. The amount of fines added to the FCC unit 210 by the fines injection system 240 may also be correlated to amount of fines in the effluent stream. The amount of new catalyst added from the container 302 to fines addition system 240 must also be factored when determining the fines inventory of the FCC unit 210. Thus, from this information, the total amount of fines lost from/present in the FCC unit 210 may be resolved.

At step 408, the amount of fines in or lost the FCC unit 210 is compared against a threshold value or process window. If the amount of fines is outside of a predefined process window (or exceeds the threshold), appropriate fines additions (or withdrawals) are made at step 410. If the amount of fines needed to return to a process state within the process window exceeds an amount of fines in the fines addition system 240 collected from the fines recovery system 214, the deficient amount of fines may be provided in the form of new fines (e.g., make-up fines) entering the fines addition system 240 from the container 302. The controller 220 may monitor the amount of fines lost and/or required from the container 302 such that the refiner may determine an amount of make-up fines needed on site, and to schedule make-up fines replenishment shipments from a vendor to ensure uninterrupted processing. Information regarding the amount of fines circulating in the FCC unit 230 may also be provided to the controller 220 as the results of an laboratory or other analysis of a representative catalyst sample, which may be utilized to determine the fines content and tune the fines addition calculation.

This cycle of monitoring the amount of catalyst is repeated in order to maintain the dynamic equilibrium of fines in the FCC unit. Advantageously, this allows the FCC unit to continue operating at or near processing limits with minimal fluctuation, thereby providing the desired product mix and emissions composition with minimal dis-optimisation, thereby maximizing the profitability of the FCC system refiner.

Although the teachings of the present invention have been shown and described in detail herein, those skilled in the art can readily devise other varied embodiments that still incorporate the teachings and do not depart from the scope and spirit of the invention.

What is claimed is:

1. A method for adding recovered fines a fluid catalyst cracking (FCC) unit, comprising:

recovering fines having an average size of from about 20 to about 40 microns and average temperature from about 100° C. to 600° C. from the FCC unit;

determining an amount of recovered fines;

transferring the recovered fines to a fines addition system; and injecting the transferred fines into the FCC unit.

2. The method of claim 1, wherein recovering the fines further comprises:

separating fines from an effluent stream exiting the fluid catalytic cracking unit.

3. The method of claim 1, wherein the step of recovering further comprises:

storing the collected fines in a container.

4. The method of claim 3 further comprising:

periodically transferring fines from the container to the fines addition system.

5. The method of claim 1 further comprising:

transferring new fines to the addition system.

6. The method of claim 1 further comprising:

adding new fines in response to the determined recovered fines amount.

7. The method of claim 1 further comprising:

determining an amount of fines being lost from the FCC unit; and replenishing fines to the FCC unit in response to the determined lost amount.

8. The method of claim 1 further comprising:

sensing a metric inactive of an amount of injected fines.

9. The method of claim 8, wherein sensing further comprises:

sensing a metric indicative of a weight of fines passing through the fines addition system.

10. The method of claim 9 further comprising:

automatically injecting the fines in response to a metric indicative of fines within the FCC unit.

11. The method of claim 1 further comprising:

pressurizing the fines addition system;

transferring the pressurized fines to the FCC unit;

depressurizing the fines addition system; and adding fines to the depressurized fines addition system.

12. The method of claim 1 further comprising:

venting the internal volume of the fines addition system to an effluent stream of the FCC unit.

13. The method of claim 12 further comprising:

separating fines from fluid vented from the fines addition system.

14. The method of claim 13 further comprising:

returning separated fines to the fines addition system.

15. An apparatus for injecting fines into an fluid catalyst cracking (FCC) unit, comprising:

pressure vessel suitable for high temperature operation;

a fill port formed in the pressure vessel;

a vent port formed in the pressure vessel;

a fines removal device coupled to the vent port;

a first discharge port formed in a lower section of the pressure vessel;

a metering device coupled to the first discharge port;

a heat dissipater positioned to cool fines entering the pressure vessel; and a sensor coupled to the pressure vessel arranged to provide a metric indicative of fines passing through the pressure vessel.

16. The apparatus of claim 15 further comprising:

a second discharge port formed in a lower section of the pressure vessel.

17. A fluid catalyst cracking (FCC) system, comprising:

a FCC unit having a regenerator and a reactor;

a catalyst addition system coupled to the FCC unit;

a fines recovery system interfaced with an effluent stream of the regenerator; and a fines addition system coupled between the fines recovery system and the FCC unit.

18. The FCC system of claim 17, wherein the fines addition system further comprises:

a sensor configured to provide a metric indicative of fines injected in to the FCC unit by the fines addition system.

19. The FCC system of claim 18, wherein the sensor provides a metric indicative of a change in weight.

20. The FCC system of claim 17 further comprising:

a tote adapted to contain fines coupled to the fines addition system.

21. The FCC system of claim 17 further comprising:

a heat dissipater positioned to remove heat from fines passing between the fines recovery system and the fines addition system.

22. The method of claim 1, wherein injecting the transferred fines into the FCC unit further comprises:

injecting fines having an average size of 20-40 microns into the FCC unit.

* * * * *